United States Patent [19]

Kasschau

[11] Patent Number: 4,511,339

[45] Date of Patent: Apr. 16, 1985

[54] THROUGH-HUB EXHAUST PROPELLER ASSEMBLY

[76] Inventor: Kenneth Kasschau, 17620 Garrett Dr., Gaithersburg, Md. 20878

[21] Appl. No.: 504,127

[22] Filed: Jun. 14, 1983

Related U.S. Application Data

[63] Continuation-in-part of Ser. No. 971,551, Dec. 20, 1978, Pat. No. 4,388,070.

[51] Int. Cl.[3] ..... B63H 5/12

[52] U.S. Cl. ..... 440/89; 416/93 A

[58] Field of Search ..... 440/89, 88; 416/93 R, 416/93 A, 93 M

[56] References Cited

U.S. PATENT DOCUMENTS

| | | | |
|---|---|---|---|
| 2,948,252 | 8/1960 | Alexander, Jr. | 440/89 X |
| 3,310,022 | 3/1967 | Kollman | 440/89 X |
| 3,467,051 | 9/1969 | Shimanckas | 416/93 M |
| 4,276,036 | 6/1981 | Nishida et al. | 440/89 |

*Primary Examiner*—Sherman D. Basinger

*Attorney, Agent, or Firm*—Fidelman, Wolffe & Waldron

[57] ABSTRACT

A boating propeller for controlling the discharge of engine exhaust gases from the central hub of a boating motor unit by making provision for confining said gases to the inner most fraction of the structure (that within the shroud) and discharging it downstream of the propeller when operating the unit in either the forward or astern mode of operation.

6 Claims, 4 Drawing Figures

THROUGH-HUB EXHAUST PROPELLER ASSEMBLY

BACKGROUND OF THE INVENTION

This application is a continuation-in-part of application Ser. No. 971,551 filed Dec. 20, 1978 now U.S. Pat. No. 4,388,070 and entitled "Propeller Exhaust Hub and Shroud."

This invention relates to a propeller with a through-hub exhaust structure for a marine propulsion device in which a shroud serves as a flow control unit to channel the exhaust downstream from the propeller area in either direction of motion, forward of astern.

Modern outboard marine propulsion devices discharge exhaust gases below the surface of the water to exclude obnoxious exhaust gases from the cockpit area and to muffle the noise of combustion.

Many of these units discharge engine exhaust gases admixed with cooling water to the rear of the propeller area through channels (passages) within the propeller hub structure. A principal benefit of this practice is that while the boat is in forward motion, the exhaust gases effectively eliminate negative pressure in the region of the hub while still permitting the propeller blades to function in water that is not disrupted by bubbles of exhaust gas. However, this advantage is achieved at some sacrifice to operation in the astern mode, wherein the exhaust gases are discharged upstream of the propeller and mix with the water flowing through the propeller area. The presence of these exhaust gases results in a substantial reduction of the density of the fluid in which the propeller operates. This fluid density reduction results in a reduction of the reverse thrust capacity of the propulsion unit.

Several earlier attempts have been made to prevent this density reduction caused by the presence of exhaust gas bubbles in the water in which the propeller blades are operating. One such solution is presented in U.S. Pat. No. 3,467,051 which provides a marine propulsion lower unit having a means for axially shifting the propeller on its hub. Rearward axial shift of the propeller with relation to the hub when the unit is in the reverse mode of propulsion provides an opening downsteam of the propeller through which exhaust gases discharge. This design suffers from the complication introduced by the means required to achieve the axial shifting of the propeller and the fact that the proposed solution cannot readily be used to retrofit propulsion devices currently in use.

Another solution is presented in U.S. Pat. No. 4,276,036 which provides a marine propulsion unit in which the propeller hub is provided with an exhaust gas passage assembly which in turn is encircled by a second outer shroud with a radial spacing and has a rear end extending beyond the rear of the inner exhaust shroud so that during a reverse movement, the exhaust gas is forced to flow from the exhaust gas shroud through the space encased by the outer secondary shroud.

In forward operation, the propeller of U.S. Pat. No. 4,276,036 operates much like a more usual single shroud design, although the outer secondary shroud does afford a barrier to the forward migration of exhaust gas bubbles to the blade area.

Several disadvantages exist to this proposed solution. The design suffers from the complexity of the arrangement which creates manufacturing problems due to the intricate tooling requirements. The benefits acquired from this solution are offset by a heavy financial cost in the tooling for its manufacture.

U.S. Pat. No. 3,356,151 addresses a solution to the problems in forward thrust operation of exhaust gas migration forwardly over the outer surface of the exhaust gas shroud. The propeller assembly is a conventional through hub exhaust configuration which is fitted with an annular ring member fitted outside and projecting aft of the aft end of the shroud. The ring directs a flow of water through an annular gap between the ring and the outer surface of the shroud forming a hydraulic pressure seal which effectively prevents migration of exhaust gases forward to the propeller blades. The annular ring is not capable of performing the function in reverse operation which is the objective of the present invention, although it may be used in conjunction with the present invention if so desired.

Since it is only the annular ring which sets the propeller assembly of U.S. Pat. No. 3,356,151 apart from the other commercially available, state of the art propeller designs, it typifies the practice of deploying the exhaust shroud in a mating relationship with the exhaust gas port of the lower unit where the inside diameter of both port and shroud are substantially the same.

SUMMARY OF THE INVENTION

The present invention relates to a propeller structured for fluids control to achieve uniform fluid flow through essentially the entire effective propeller area during both the forward and reverse modes of propulsion, thereby providing substantially increased reverse thrust at little or no expense to forward performance.

In this embodiment of the invention, a single cylindrical shroud surrounds the propeller hub to confine exhaust gases to the innermost portion of the structure (that within the shroud) during either the forward or reverse mode of propulsion. The shroud has a diameter substantially greater than the diameter of the lower unit exhaust port. The result is that essentially the entire effective blade area operates in a water environment which is free of exhaust gas which allows the development of a full thrust capability in either mode of propulsion. In addition, exhaust gas back pressure is reduced during either mode of operation.

In operation in forward gear, the shroud of the present invention generates a substantial flow of water through the annular gap which aids the propeller in developing early thrust by aiding in the reduction of back pressure on the exhaust system, resulting in improved acceleration. At top speed, the drag effect of the shroud of the present invention is surprisingly little in comparison with the shrouds of the prior art, which do not present any increased projected area. The increased acceleration with little or no penalty at top speeds is important to high speed applications where the ability to propel a vessel onto a plane with a minimum of delay is of great import.

In reverse gear, reduced back pressure and attendant ability to attain high thrust is equally important, both for the case of reverse gear as a braking force for a vessel, or in accelerating in reverse gear to an adequate maneuvering speed. In addition, the improved flow of gases and the elimination of exhaust in the propeller operating fluid offers a material net increase in thrust in the reverse gear operation.

Greater initial thrust and acceleration and greater maximum thrust in reverse gear are particularly important when maneuvering in close quarters, giving the operator greater control over the handling of the vessel, and thus, a greater margin of safety in operations.

This simple and inexpensive solution avoids the problems inherent in the structures and arrangements proposed in the prior art. The invention requires no structural or mechanical modifications to the lower unit of marine propulsion devices. It may be used to retrofit any through-hub exhaust propulsion device currently in use, and there is no need for axial movement of the propeller. In addition, it is relatively simple to manufacture and easy to install.

OBJECT OF THE INVENTION

It is the object of this invention to provide a means for discharging exhaust gases downstream of the propeller when operating the marine propulsion device to which it is connected in either the forward or reverse mode.

It is another object of this invention to provide a propeller suitable for use on conventional through-hub exhaust marine propulsion devices which exhausts gases downstream of the propeller when operating the device in either the forward or reverse mode.

It is still another object of this invention to provide a propeller suitable for retrofitting marine propulsion devices currently in use to achieve the abovedesired objects.

Other objects, features, and advantages of the invention may be understood with reference to the following detailed description and the appended drawings in which.

DETAILED DESCRIPTION OF THE INVENTION

Figure 2:
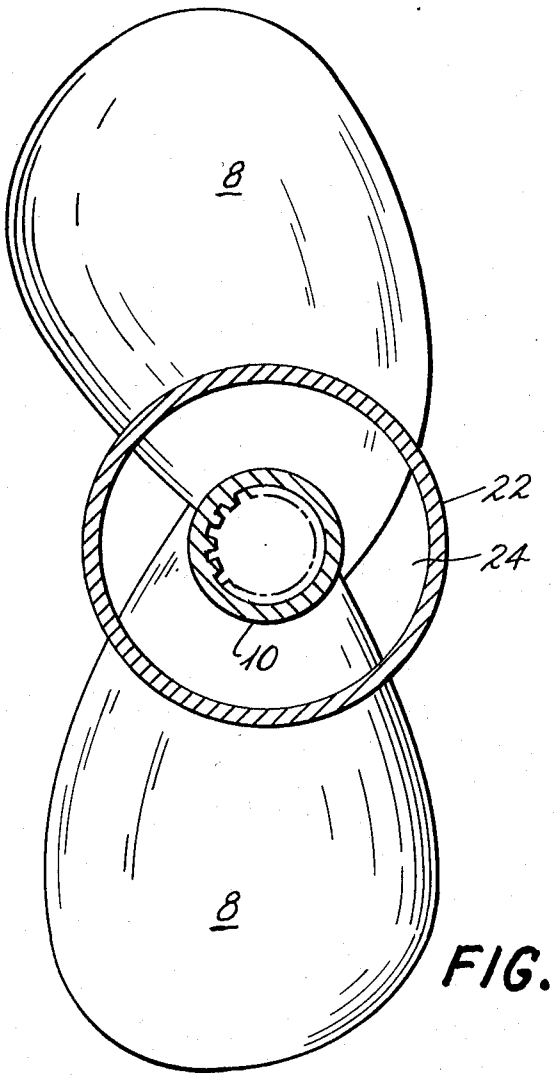
FIG. 2 is a cross-sectional view of the propeller hub of FIG. 1 taken through section line 2'—2'.
Figure 1:
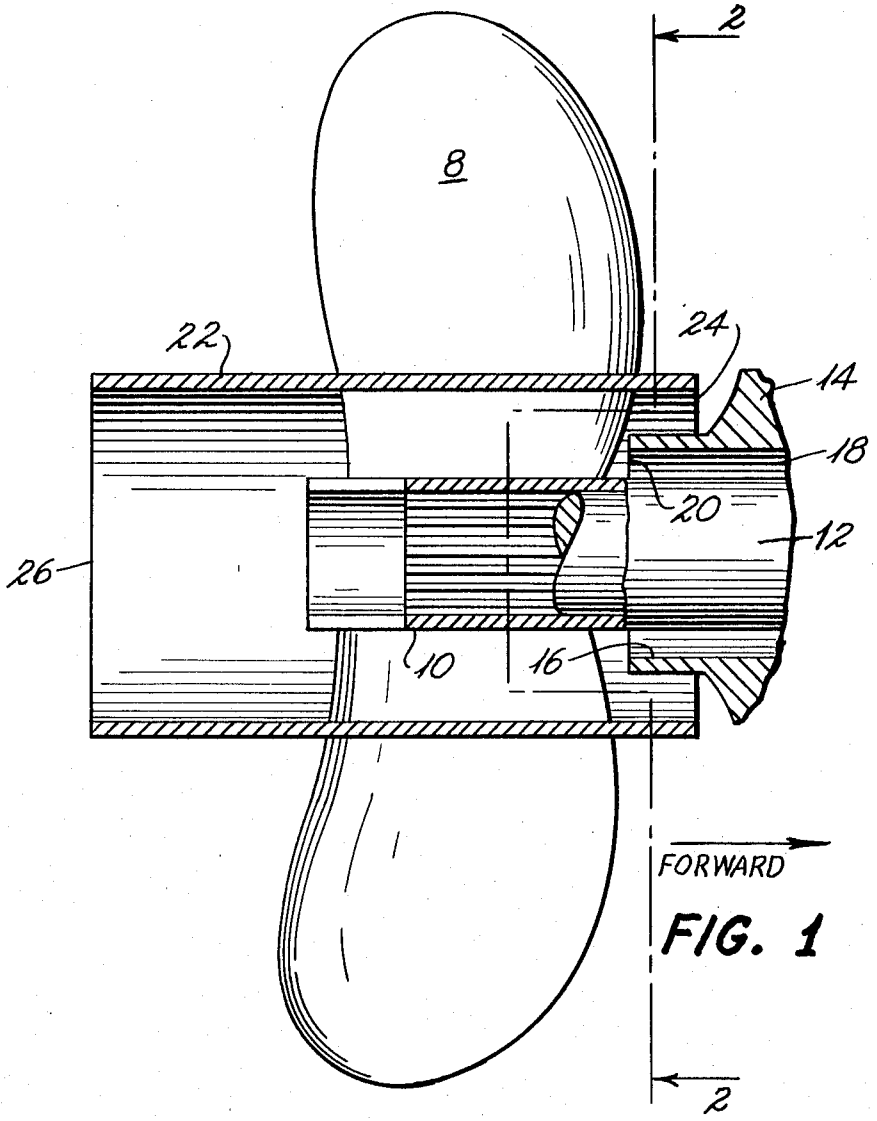
FIG. 1 is a side cross-sectional view through the center of a propeller and hub assembly equipped with the shroud of the invention.

FIG. 1 shows a modified propeller design in which the blades 8 are supported by and drivably attached to a sleeve 10 for drivable attachment to the propeller shaft 12 supported within lower unit housing 14 by bearings (not shown). A cylindrical shroud 22 surrounds the sleeve 10 and is of a diameter sufficiently large to define a forward opening 24 concentric with the rearward extension 16 of lower unit housing 14. The area of the forward opening 24 of the cylindrical shroud defines an annular gap which is from about 50% less than to about 200% greater than the area of the opening of the exhaust port 20. It is preferred that these areas be about equal. Housing 14 incorporates a rearwardly extending portion 16 forming a passage 18 between shaft 12 and housing 14 and its rearward extension 16. Said passage provides for discharge of engine exhaust gases through exhaust port 20 at rearmost end of passage 18 defined by the termination of extension 16 at the rearward face of housing 14.

It can be seen that absent the cylindrical shroud, the exhaust gases would be discharged into the working area of the propeller blades thus reducing the fluid density available to the propeller blades and thereby reducing the power of thrust.

In the present invention said shroud 22 extends forward of after opening 20 by an amount limited only by interference with lower unit housing 14, and extends aft of blades 8 by an amount sufficient to convey exhaust gases beyond the aftmost portions of the blades and to prevent leakage of exhaust gases forwardly along the outer surface of shroud 22. An annular gap 24 is provided at the forward end of shroud 22 between said shroud and the rearward extension 16 of housing 14. The area of the annular gap 24 approximates the area of annulus 18 between shaft 12 and housing 14.

In the forward mode of operation, the entire propeller assembly rotates, driven by shaft 12 in the customary fashion. The portion of the propeller blades 8 outside shroud 22 generate thrust as is usual. The root portions of propeller blades 8, i.e., the portions inside shroud 22 also serve to generate thrust which functions to draw water in through annular gap 24, mixing it with exhaust gases exiting exhaust port 20, and forcing the mixture out through the after end opening 26. The inward flow of water through annular gap 24 is sufficient to preclude any flow of exhaust gases via annular gap 24 into the working environment of the propeller blades 8 outside shroud 22. Additionally, the positive pumping action generated by the root portions of propeller blades 8 causes exhaust gases to be combined with the water flow inside shroud 22 and its positive ejection rearwardly through opening 26, so that there is less tendency for these gases to attach to the surface of shroud 22 and migrate over the surface to the propeller blades 8. The annular ring on the trailing edge of shroud 22, as employed in U.S. Pat. No. 3,356,151 will thus not often be required or desired.

In addition, the positive induced flow of water through shroud 22 has added significance during acceleration, whether from rest or in reversing the direction of thrust, or in increasing from low speed to a higher speed. In each of these operations, the flow of exhaust gases is materially increased as the engine throttle is opened, and this flow is required to operate against the prior equilibrium conditions. Particularly in acceleration from rest with prior art propellers there is a very substantial back pressure against which the engine must work and this can in some cases substantially limit acceleration. In the present invention, induced flow of water through shroud 22 serves to very quickly reduce back pressure to a low level, minimizing engine loading and maximizing the application of engine power to the generation of thrust. Because of the segregation of gas and water flows, which is a factor of the dual-shrouds of U.S. Pat. No. 4,276,036, this back pressure reducing phenomenon which provides a positive enhancement of acceleration will be absent or at least minimal.

In reverse operation, the propeller of the present invention will operate in substantially the same fashion as previously described except that the flows will be reversed, with water flowing into aft opening 26 and the mixture of water and exhaust gases exiting shroud 22 via annular gap 24. As can be readily seen, this discharge is downstream of propeller blades 8 in reverse operation, so that all the same advantages are attained as in forward operation.

Because of the greater efficiency of operation of the propeller of the present invention, it is not generally necessary to alter pitch or diameter of the propeller in order to produce a given level of performance with a given combination of engine, prop, and vessel. It may be possible, however, to increase performance by increasing pitch or diameter, or some combination of both, in light of the reduction of exhaust gas back pressure.

While the present invention will provide substantial improvements in the operations of substantially all vessels, one class of vessels will be most aided. This will be those vessels where the lower unit is fixed in relation to the hull of the vessel and not able to direct the propeller action as a component of steering the vessel. This type of operation is common with many small sailing vessels which are steered with a rudder. These operating characteristics are more generally significant to low speed, high thrust applications generally. When operating at very low speeds, particularly in reverse, these vessels can be very difficult to manuever, particularly when operating in close quarters in the vicinity of other vessels and piers and the like. The enhanced acceleration and the improved thrust in reverse is a great improvement and a great safety enhancement in such applications.

Various other embodiments can be used in conjunction with the present invention without interfering with the advantages. While such additional embodiments are generally not required and add unnecessary complexity, there are some circumstances where the use thereof may be desirable. The most significant of these configurations/arrangements/modifications are achieved by the addition of an inducer (FIG. 3), or a diffuser(FIG. 4).

Figure 3:
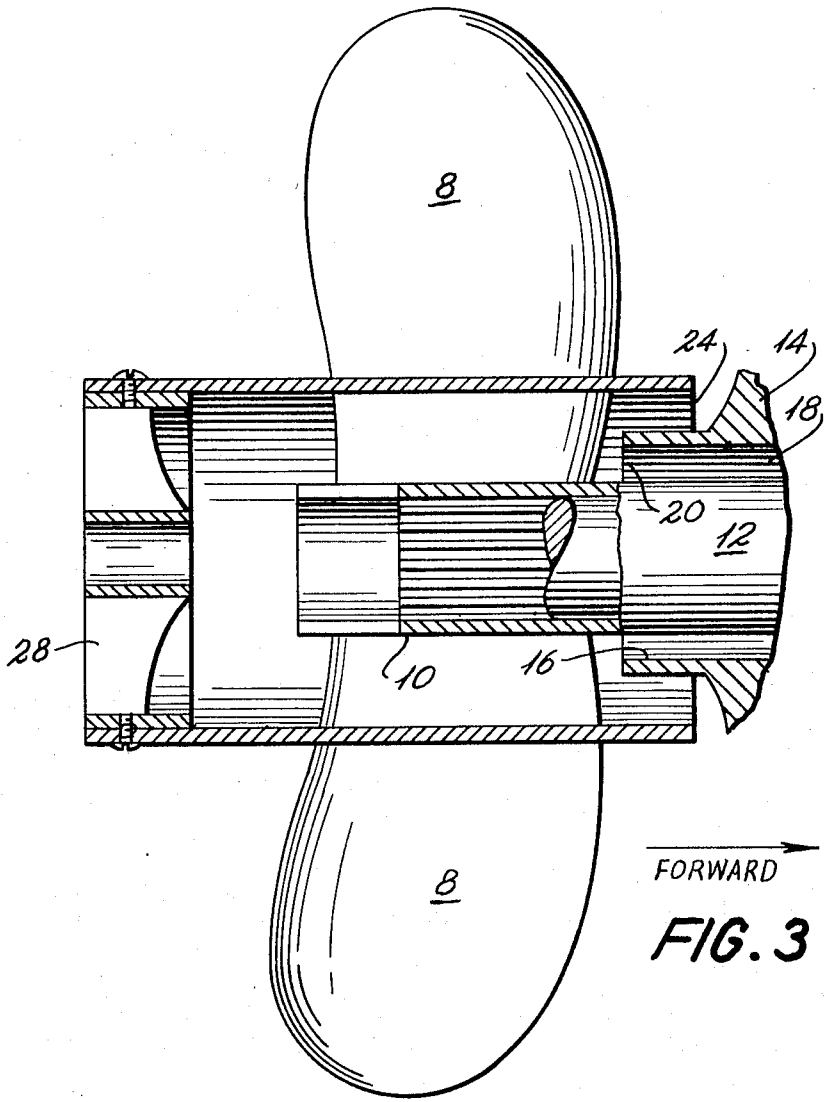
FIG. 3 is a side cross-sectional view of the propeller hub of FIG. 1 in which the internal area of the shroud is fitted with an inducer.

In FIG. 3, an inducer 28 is incorporated into the interior of the shroud 22 and may or may not be continuous with the portions of the blades immediately exterior to the shroud 22. The inducer enhances the flow of the exhaust gas/water mixture through the shroud 22 and out the after-end opening 26 during a forward mode of thrust or out the gap 24 during a reverse mode of thrust. Optimum flow considerations within the shroud may dictate certain modifications to the blade angle and to the configurations/arrangements within the shroud, depending upon the dimensions of the shroud. For example, it may be desirable to locate an inducer within the forward end of shroud 22 rather than in the after end.

Figure 4:
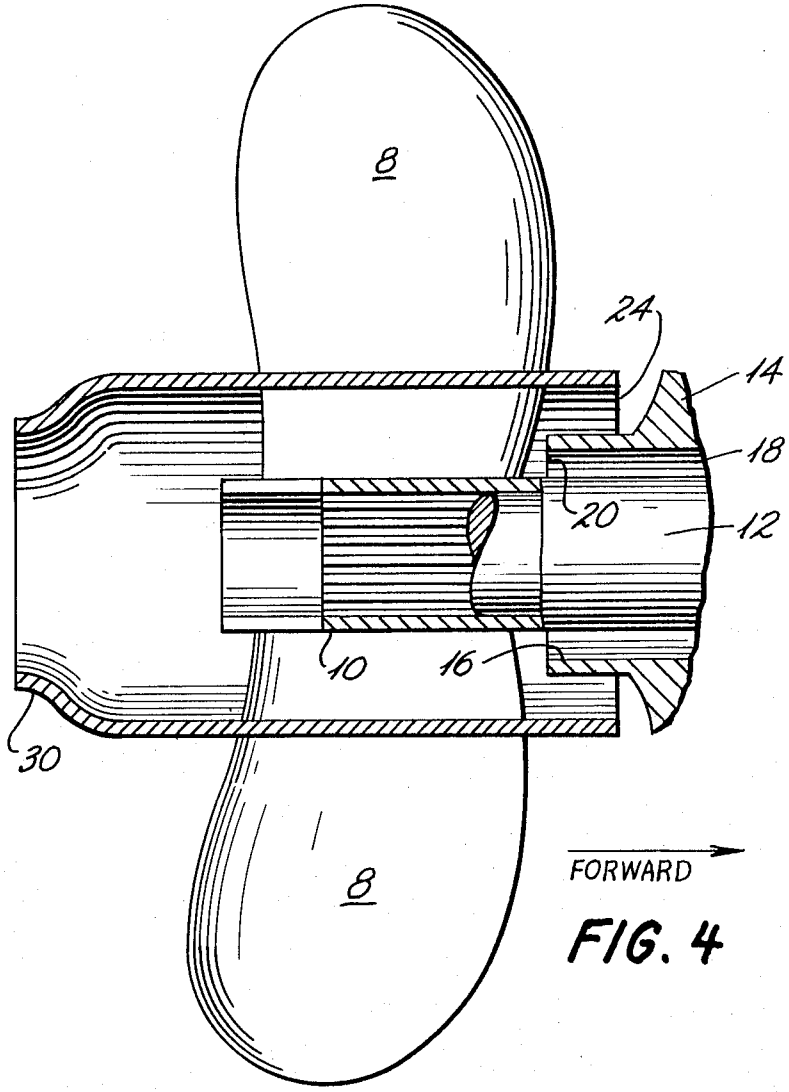
FIG. 4 is an alternate embodiment which shows a side cross-sectional view of the rearward portion of the shroud of the invention formed so as to form a diffuser.

In FIG. 4, the rearward portion of the shroud 22 is formed so as to form a diffuser 30. The diffuser enhances the ejection of the exhaust gas/water mixture through the shroud during the forward mode of thrust at little or no expense to the reverse mode of thrust.

What is claimed is:

1. A propeller for a through-hub exhaust marine propulsion device, comprising:

a housing surrounding a propeller shaft, said housing having a rearward opening with a diameter, said rearward opening of said housing and said propeller shaft defining a rearwardly disposed exhaust port;

a sleeve driveably attached to said propeller shaft, said sleeve having a diameter substantially less than the diameter of said rearward opening;

at least one propeller blade having an inner end and an outer end extending from and attached to said sleeve; and a single annular shroud means concentric with said sleeve and said propeller shaft and attached to said propeller blade intermediate said inner and outer ends of said blade, said annular shroud means having a forward opening and a rearward opening, said forward opening of said single annular shroud means, concentric with said rearward opening of said housing, having a greater diameter than said rearward opening of said housing, said concentric forward opening of said annular shroud means and said rearward opening of said housing defining an annular gap, said annular shroud means conducting exhaust gases and engine cooling water forward of the forward face of said propeller blade when said propulsion device is operating in the reverse mode and rearward of the rearward face of said propeller blade when said propulsion device is operating in the forward mode.

2. The propeller of claim 1, wherein said annular shroud means extends forward to said forward face of said propeller blade.

3. The propeller of claim 1, wherein the forward opening of said annular shroud means is forward of said forward face of said propeller blade.

4. The propeller of claim 1, wherein the area of said annular gap is from about 50% less than to about 200% greater than the area of said rearwardly disposed exhaust port.

5. The propeller of claim 1, wherein the area of said annular gap is about twice the area of said rearwardly disposed exhaust port.

6. The propeller of claim 1, wherein the area of said annular gap is about equal to the area of said rearwardly disposed exhaust port.

* * * * *